United States Patent [19]

Wassilak et al.

[11] Patent Number: 4,821,535

[45] Date of Patent: Apr. 18, 1989

[54] COUPLING DEVICE FOR WASHER AND DRYER

[75] Inventors: Chester W. Wassilak, St. Joseph; Richard J. Conrad, Lincoln Township, Berrien County, both of Mich.

[73] Assignee: Whirlpool Corporation, Benton Harbor, Mich.

[21] Appl. No.: 139,003

[22] Filed: Dec. 29, 1987

[51] Int. Cl.[4] ..... D06F 39/00

[52] U.S. Cl. ..... 68/3 R; 68/20; 312/199; 211/186; 248/639

[58] Field of Search ..... 68/3 R, 20, 19.2; 248/639, 676; 211/186, 188, 149, 194, 198; 312/198, 199, 263, 264

[56] References Cited

U.S. PATENT DOCUMENTS 1,585,102 5/1926 Langdon .
1,763,306 6/1930 Hendrickson .
1,880,733 10/1932 Bolhuis .
2,218,300 10/1940 Schuster .
2,793,518 5/1957 Geldhof .
4,454,732 6/1984 Burkland .
4,507,942 4/1985 Hirose et al. .
4,680,948 7/1987 Rummel et al. .
4,713,949 12/1987 Wilcox ..... 68/3 R

*Primary Examiner*—Harvey C. Hornsby
*Assistant Examiner*—Frankie L. Stinson
*Attorney, Agent, or Firm*—Hill, Van Santen, Steadman & Simpson

[57] ABSTRACT

A coupling device is provided for mounting a dryer above a washer wherein the device includes side brackets attachable to side walls of the washer to permit removal of the washer top panel without disassembly of the coupling device or removal of the dryer. A rear brace strengthens the coupling device and a front panel provides a finished look. A rear spacer bracket is used if an exhaust conduit is to be directed downwardly behind the dryer, the spacer bracket preventing crushing or dislodging of the conduit.

19 Claims, 2 Drawing Sheets

FIG. 1
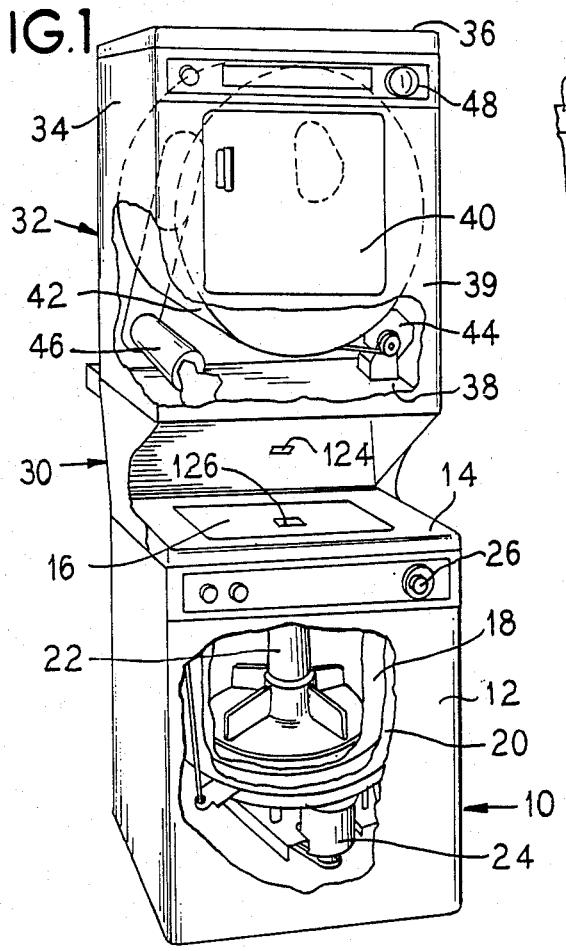
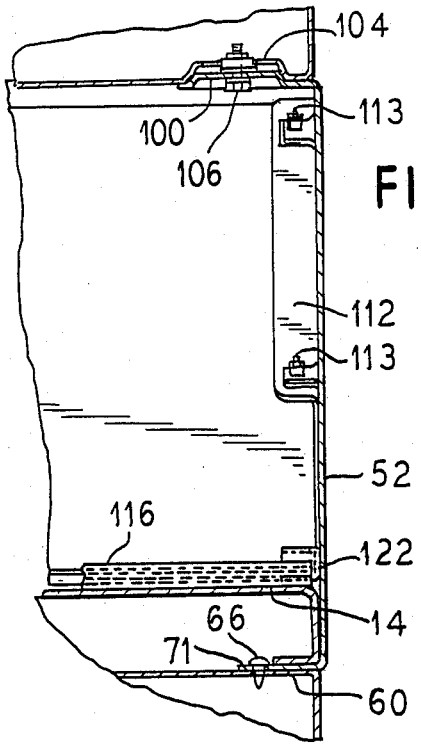
FIG. 6
FIG. 2
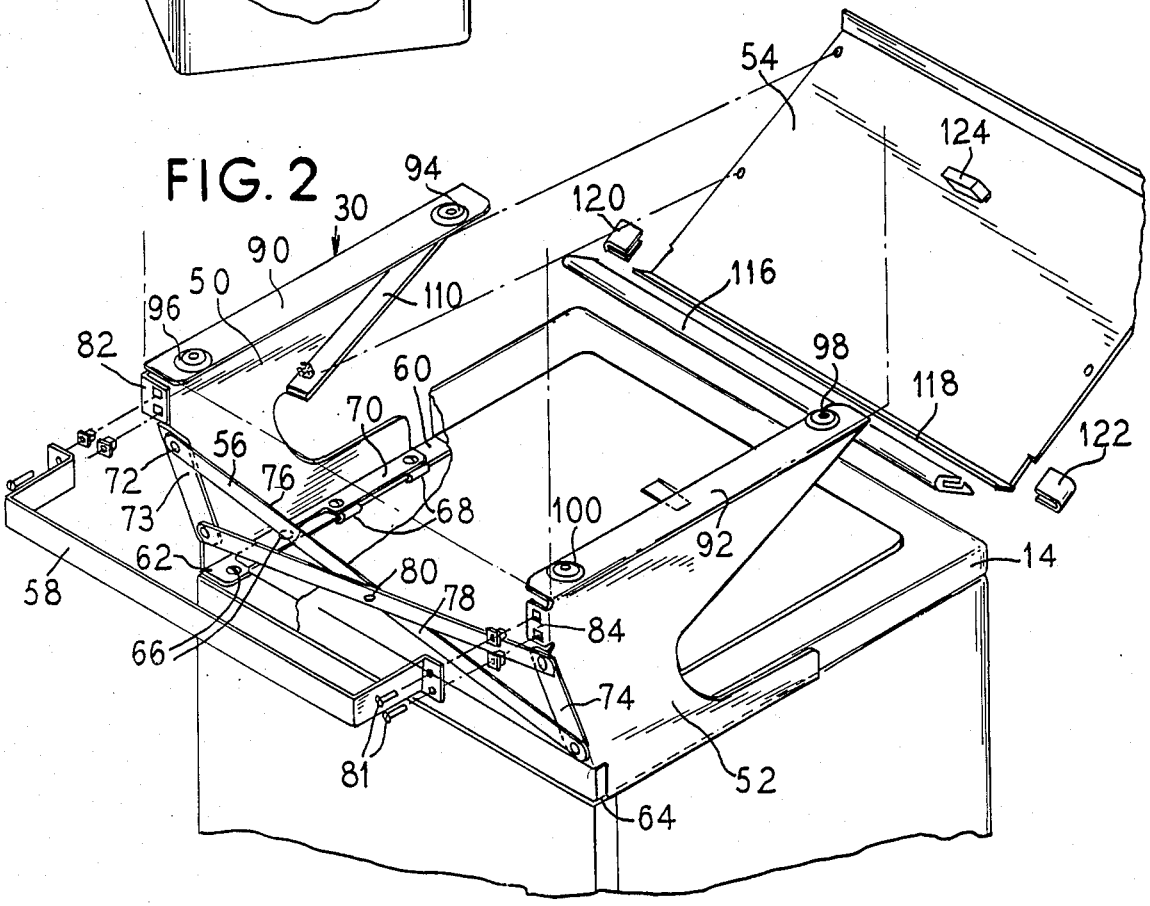

COUPLING DEVICE FOR WASHER AND DRYER

BACKGROUND OF THE INVENTION

1. Field of the Invention

This invention relates generally to domestic appliances and more particularly to a coupling device permitting a front loading dryer to be mounted above a top loading washer.

2. Description of the Prior Art

The vertical stacking of washers and dryers is employed to conserve floor space and increase the ease of use of the appliances by positioning the openings of the two appliances closely adjacent to one another to reduce movement required by the operator while moving articles from one appliance to the other. Such a stacked arrangement is disclosed in U.S. Pat. No. 2,793,518 which was assigned to a predecesor of the assignee of the present invention. While that patent discloses a combined washing and drying machine in which the washer and dryer cabinet were more or less permanently mounted together, it is also desirable to provide a mounting bracket to attach to the washer and dryer cabinets to permit the vertical stacking of the two normally independent appliances.

U.S. Pat. No. 4,680,948 discloses a bracket assembly which permits a dryer to be mounted on a washer, the bracket resting on a top surface of the washer cabinet. In some washer cabinet constructions, such as that employed by the assignee of the present invention, it is necessary or desirable to remove the top panel of the washer to service various components located on the interior of the cabinet. Therefore, if the connecting bracket rested on the top panel of the washer, then the entire dryer and bracket assembly must be removed prior to servicing the interior of the washer. This obviously is a severe disadvantage.

SUMMARY OF THE INVENTION

The present invention provides a coupling device for a standard washer and dryer which permits the washer and dryer to be stacked vertically, and also permits the interior of the washer to be serviced by removal of the top panel of the washer without removal of the coupling device or dryer. A bottom portion of the device attaches to an inwardly turned flange on the cabinet sidewalls, below the top panel of the washer which permits removal of the washer top panel without disassembly of the coupling device and dryer.

The coupling device includes alignment contours which mate with corresponding contours on a bottom panel of the dryer to assist in alignment in the dryer relative to the coupling device and includes latching means to hold the washer lid in an open position while clothes are being loaded into the washer. The coupling device also includes a spacer member to provide proper spacing of the washer/dryer assembly relative to a wall in the building where the appliances are located in the event that the dryer exhaust duct is to be directed downwardly from the back wall of the dryer. A brace structure is provided between two separate side support brackets of the coupling device which provides sufficient rigidity to the coupling device to permit movement of the stacked washer and dryer assembly without requiring disassembly of the appliances for such moving.

The coupling device is secured to both the washer and dryer by threaded fasteners extending through preexisting apertures in the washer and dryer frames, which apertures are not visible on the finished washer and dryer cabinets, and therefore the fastening of the coupling device results in a pleasing aesthetic appearance in which the fasteners holding the brackets to the appliances are concealed therefore providing a finished appearance to the assembled appliances.

BRIEF DESCRIPTION OF THE DRAWINGS

FIG. 1 is a perspective view of a dryer mounted above a washer with a coupling device embodying the principles of the present invention.

FIG. 2 is a rear perspective view of the coupling device as mounted on the washer in a partially exploded view.

FIG. 6 is a sectional view of the fastening arrangement between the coupling device and the washer and dryer taken generally along the line VI—VI of FIG. 3.

DETAILLED DESCRIPTION OF THE PREFERRED EMBODIMENTS

Figures 3, 4, 5:
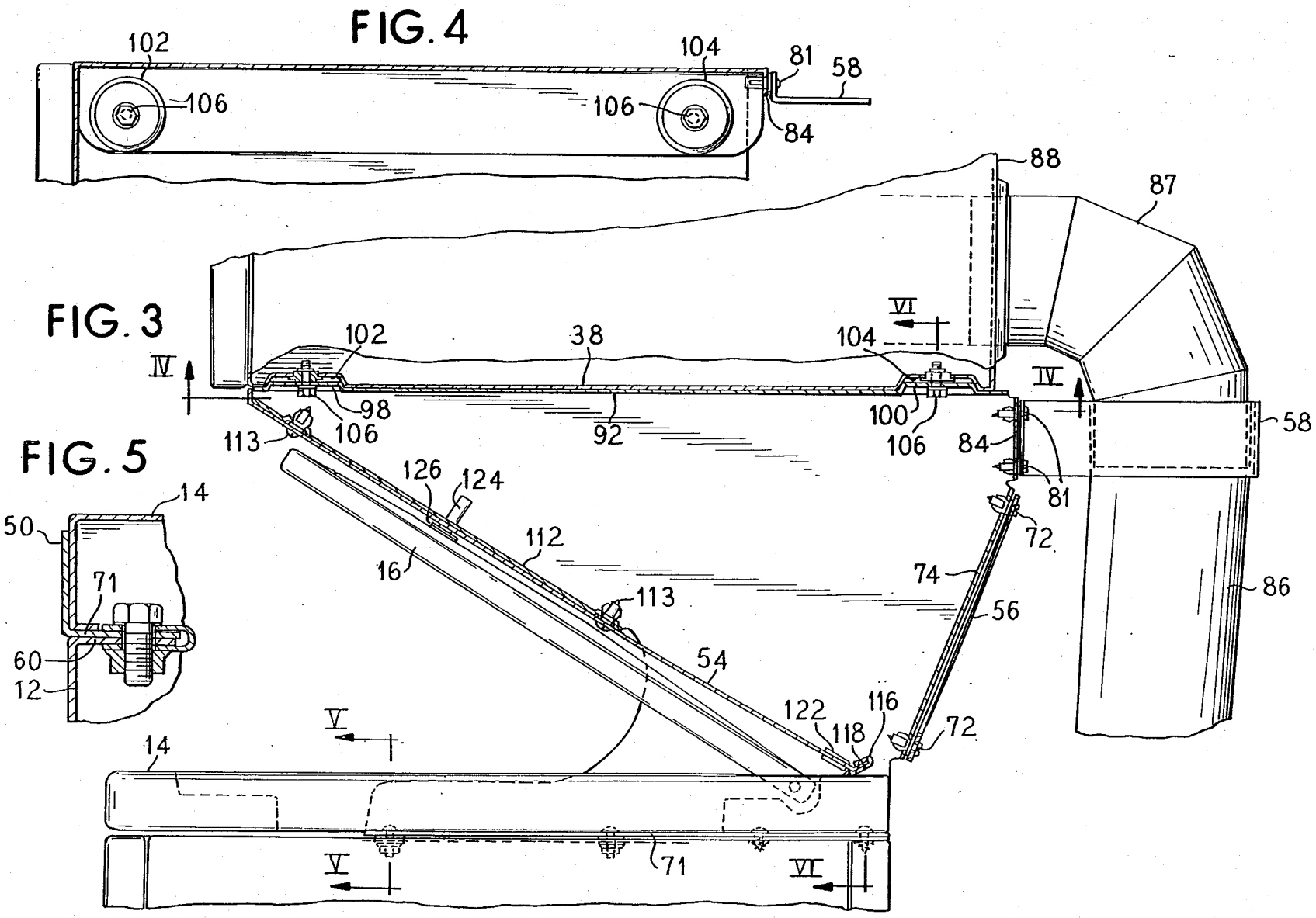
FIG. 3 is a side sectional view of the coupling device in place between the washer and dryer.
FIG. 4 is bottom view of the connection to the dryer as viewed along line IV—IV of FIG. 3.
FIG. 5 is a sectional view of the forward fastening arrangement between the coupling device and the washer taken generally along the line V—V of FIG. 3.

In FIG. 1 there is illustrated a clothes washing machine generally at 10 which has a cabinet formed of side panels 12 and a top panel 14. In the top panel 14 there is a hinged access door 16 which provides access to the interior of the washer wherein a basket 18 is concentrically mounted within a wash tub 20. A vertical axis agitator 22 is carried within the wash basket 18 and is selectively driven by an electric motor 24. A plurality of controls 26 are provided near a top front edge of the washer by which a user can select a preprogrammed series of washing, rinsing and drying steps.

A coupling device 30 extends upwardly beyond the top panel 14 of the washer and serves as a mounting arrangement for a dryer 32 which is mounted in a vertical relationship with the washer. The dryer 32 has a cabinet with side panels 34, a top panel 36 as well as a bottom panel 38. A front side panel 39 has a hinged door 40 which provides access to the interior of a rotatable drum 42 in which the clothes are to be placed for drying. The drum 42 is rotated by means of an electric motor 44 and a heater 46 is provided to supply tempered air to the interior of the drum. Controls 48 are also provided on the front panel of the dryer cabinet through which the user can select a preprogrammed series of drying steps.

The coupling device 30 of the present invention is shown in greater details in FIGS. 2–6 where it is seen that the coupling device is composed of a plurality of components which include a right 50 and left 52 side support member, a front panel 54, a rear brace 56 and a rear spacer bracket 58. The coupling device also includes various fasteners and other components described in greater detail below.

To install the coupling device to the washer and dryer, the top panel 14 of the washer is first removed which exposes a top inwardly turned flange 60 of the side panels 12, which flange extends around the entire periphery of the side panels. Near a right rear corner 62 and a left rear corner 64 of the side panel flange there will be exposed two screws 66 which are part of the washer cabinet assembly which are to be removed. Then, two cage nuts 68 are slipped onto the side flanges 60 just forward of the locations of the removed screws so that four apertures will be provided at each side for receiving fasteners.

Each side support piece or member 50, 52 has a bottom inwardly turned flange 70, 71 which is designed to rest on the side panel flange. The support flange 70, 71 has four apertures therethrough which are to be aligned with the four apertures described above to permit threaded fasteners, including the screws previously removed from the washer cabinet to be inserted through the support piece apertures and securely fastened to the side panel flanges of the washer cabinet. In this manner, the side supports will be attached to the washer cabinet in a secure manner. The top panel 14 of the washer can then be reattached above the side panels 12.

The rear brace 56 can be attached to the two side pieces 50, 52 by appropriate fasteners 72 which secure to inwardly turned rear flanges 73, 74 on the side pieces. The preferred embodiment of the rear brace is illustrated as being in the form of two straps 76, 78 which are riveted together at a center point 80 such that the rear brace is in the form an x. A single solid panel or other configuration of the brace could also be utilized. The use of the brace provides additional rigidity to the coupling device, particularly where the washer and dryer are to remain coupled during movement such as from one room to another or from one house to another. Also such a rear brace permits access to the utilities (i.e. water, electric hook up) from the front of the unit whereas a single solid panel would require hook up prior to final positioning. The cross brace also allows for servicing in final position because the power supply and water can be disconnected without moving the unit.

The rear spacer bracket 58 can be attached to the side supports 50, 52 again by appropriate threaded fasteners 8 secured to separate inwardly turned rear flanges 82, 84 if the dryer is to be used in a configuration, such as illustrated in FIG. 3, wherein an exhaust conduit 86 includes an elbow 87 to direct the conduit downwardly behind the dryer. The bracket 58 would then provide adequate spacing between a rear wall 88 of the dryer cabinet and an adjacent wall of the building to prevent crushing or dislodging of the exhaust conduit. If straight through exhaust is provided, then the bracket 58 need not be attached.

Next, the dryer is to be lifted up and placed on top of the side supports, the side supports each having an inwardly turned top flange 90, 92 which has formed therein pressed out contours 94, 96, 98, 100 which mate and nest with corresponding recesses or pockets 102, 104 (and two others not shown) formed in the bottom wall 38 of the dryer cabinet, which normally receive the foot pads for the dryer. The foot pads are to be removed prior to setting the dryer on the side support members. Provision of the contours permits exact alignment of apertures between the flanges 90, 92 of the side supports and apertures in the bottom wall 38 of the dryer such that shifting of the dryer on the top flange to align the apertures is not necessary, the apertures will self align when the contours are nested. Threaded fasteners 106 are then inserted up through the apertures in the top flanges 99, 92 and engage in the aperture in the dryer bottom wall 28 which previously held the foot pads so as to securely hold the dryer cabinet on the side supports.

The final step is to attach the front panel 54 which is secured to inwardly turned flanges 110, 112 of the side support members which are oriented at an angle to the parallel top and bottom flanges 90, 70 such that the panel 54 in its assembled position will slope downwardly and rearwardly. Threaded fasteners 113 are used to secure the panel 54 to the flanges 110, 112 and a cover member 116 attaches to a bottom a rearward edge 118 of the panel to engage against the washer top panel 14 to provide a finished joint appearance at the lower rear edge of the panel 54. The cove 116 preferably is formed out of an elastomeric material which also acts as a vibration and sound dampening member so that no rattling will occur between the panel 54 and the cabinet top panel 14.

Side bumpers 120, 122 are provided which attach to the front panel 54 at the side edges near the lower rear edge 118. The bumpers 120, 122, also preferably fabricated of an elastomeric material, engage the side panels 50, 52, as seen in FIG. 6, to provide a slight spacing between the side edge of the panel 54 and the side members and to prevent vibration noise from developing along those surfaces.

The front panel 54 also carries a magnetic latch 124 which protrudes through the panel 54 so that the magnet is exposed. A strike plate 126 is secured to the washer door 16, such as by an adhesive, so that when the door 16 is opened into engagement with the front panel 54, as seen in FIG. 3, the magnet 124 will engage the strike plate 126 and will hold the door 16 in the open position until the user provides a sufficient downward force on the door.

Thus the present invention provides a coupling kit which permits normally independent washers and dryers to be assembled in a stacked relationship. The coupling device does not interfere with servicing of the interior of the washer, permitting removal of the washer top panel without any disassembly of the coupling device. After assembly of the device, there is a finished appearance with the fastening members connecting the support members to the washer and dryer concealed from view.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A coupling device to provide for vertical mounting of a top appliance having a horizontal base wall with upwardly directed depressions formed therein and a bottom appliance having a removable top panel and vertical side walls with inwardly turned horizontal flanges at a top edge of said side walls positioned below said top panel, said coupling device comprising two support members, each having:

a lower flange having a bottom side which defines a lower mounting surface to engage said horizontal side wall flanges independent of said top panel;

an upper flange having a top side which defines an upper mounting surface to engage said base of said top appliance, said top side of each upper flange has contours formed therein which mate with said depressions formed in said top appliance base wall; and supporting means joining said upper flange to said lower flange in a spaced parallel relationship and being capable of supporting said top appliance.

2. A coupling device according to claim 1, wherein apertures are provided in said upper flanges to receive threaded fasteners for securing said upper appliance to said support members.

3. A coupling device according to claim 1, wherein apertures are provided in said lower flanges to receive threaded fasteners for securing said lower appliance to said support members.

4. A coupling device according to claim 1, including a rear brace member interconnecting said two support members.

5. A coupling device according to claim 1, including a front panel extending at an angle from vertical between said two support members.

6. A coupling device to provide for vertical mounting of a top appliance having a horizontal base wall with upwardly directed depressions formed therein and a bottom appliance having a removable top panel and vertical side walls with inwardly turned horizontal flanges at a top edge of said side walls positioned below said top panel, said coupling device comprising two support members, each having:

a lower flange having a bottom side which defines a lower mounting surface to engage said horizontal side wall flanges independent of said top panel;

an upper flange having a top side which defines an upper mounting surface to engage said base of said top appliance; and supporting means joining said upper flange to said lower flange in a spaced parallel relationship and being capable of supporting said top appliance; and including a rear spacer bracket secured between rear edges of said two support members and extending rearwardly of said members.

7. A coupling device according to claim 6, wherein apertures are provided in said upper flanges to receive threaded fasteners for securing said upper appliance to said support members.

8. A coupling device according to claim 6, wherein apertures are provided in said lower flanges to receive threaded fasteners for securing said lower appliance to said support members.

9. A coupling device according to claim 6, including a rear brace member interconnecting said two support members.

10. A coupling device according to claim 6, including a front panel extending at an angle from vertical between said two support members.

11. A coupling device to provide for vertical mounting of a top appliance having a horizontal base wall with upwardly directed depressions formed therein and a bottom appliance having a removable top panel and vertical side walls with inwardly turned horizontal flanges at a top edge of said side walls positioned below said top panel, said coupling device comprising two support members, each having:

a lower flange having a bottom side which defines a lower mounting surface to engage said horizontal side wall flanges independent of said top panel;

an upper flange having a top side which defines an upper mounting surface to engage said base of said top appliance; and supporting means joining said upper flange to said lower flange in a spaced parallel relationship and being capable of supporting said top appliance;

including a front panel extending at an angle from vertical between said two support members; and said bottom appliance has a door on said top panel openable towards said front panel, and including a latch member carried on said front panel engageable with said door of said bottom appliance to hold it in an open position against said front panel.

12. A coupling device according to claim 11, wherein apertures are provided in said upper flanges to receive threaded fasteners for securing said upper appliance to said support members.

13. A coupling device according to claim 11, wherein apertures are provided in said lower flanges to receive threaded fasteners for securing said lower appliance to said support members.

14. A coupling device according to claim 11, including a rear brace member interconnecting said two support members.

15. A coupling device kit to provide for vertical mounting of a dryer appliance above a washer appliance, comprising:

two side support pieces, each piece having an upper flange engageable with said dryer, a lower flange engageable with said washer, a supporting wall joining the two flanges in a spaced parallel relationship, an angled front flange and a rear flange, a rear brace member engageable with said two support pieces at said rear flanges, a front panel member engageable with said two support support pieces at said front flanges, and appropriate fastening members to secure said side pieces to said panels, said brace and said appliances.

16. A coupling device kit according to claim 15, wherein each of said side pieces include a second rear flange and said kit includes a rear spacer bracket which is engageable with said side pieces at said second rear flanges to extend rearwardly of said side pieces.

17. A coupling device to provide for vertical mounting of a dryer appliance having a horizontal base wall with upwardly directed foot pad pockets formed therein, said foot pad pockets having threaded apertures therein, and a bottom appliance having a removable top panel with a hinged door therein and vertical side walls with inwardly turned horizontal flanges at a top wall of said side walls positioned below said top panel, comprising:

two support members, each having:

a lower flange having a bottom side which defines a lower mounting surface to engage said horizontal side wall flanges independent of said top panel;

an upper flange having a top side which defines an upper mounting surface to engage the base of said top appliance;

said top side of each upper flange having countours formed therein which mate with said pockets formed in said dryer bottom wall;

a supporting wall joining said upper flange to said lower flange in a spaced parallel relationship and being capable of supporting said dryer;

a front flange formed at an angle from vertical on a front edge of said supporting wall;

a rear flange formed at a rear edge of said supporting wall;

a rear brace member engageable with said two support members at said rear flanges; and a front panel member engageable with said two support members at said front flanges.

18. A coupling device according to claim 17, wherein said two support members each have a second rear flange and including a rear spacer bracket which is engageable with said support members at said second rear flanges and which extends rearwardly of said support members.

19. A coupling device according to claim 17, wherein said washer door opens toward said front panel, and including a latch member carried on said front panel engageable with said door to hold it in an open position against said front panel.

* * * * *